US008336485B2

(12) United States Patent
Pei

(10) Patent No.: US 8,336,485 B2
(45) Date of Patent: Dec. 25, 2012

(54) COATING APPARATUS

(75) Inventor: Shao-Kai Pei, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 231 days.

(21) Appl. No.: 12/848,209

(22) Filed: Aug. 1, 2010

(65) Prior Publication Data

US 2011/0179994 A1 Jul. 28, 2011

(30) Foreign Application Priority Data

Jan. 27, 2010 (TW) ..... 99102212 A

(51) Int. Cl.
*B05B 3/00* (2006.01)
*B05C 11/02* (2006.01)

(52) U.S. Cl. ..... 118/323; 118/52; 118/612

(58) Field of Classification Search ..... 118/321, 118/323, 313–315, 52, 612, 56; 427/427.3; 366/249

See application file for complete search history.

(56) References Cited

U.S. PATENT DOCUMENTS 2,858,762 A * 11/1958 Wade ..... 99/287
2,930,596 A * 3/1960 Waters ..... 366/279
4,522,505 A * 6/1985 Medd ..... 366/343
5,582,644 A * 12/1996 Gaddis et al. ..... 118/303
5,765,947 A * 6/1998 Dubroy ..... 366/249

* cited by examiner

*Primary Examiner* — Yewebdar Tadesse
(74) *Attorney, Agent, or Firm* — Altis Law Group, Inc.

(57) ABSTRACT

A coating apparatus includes a first vessel, a revolving unit, and a motor having a drive shaft. The first vessel has a receiving space defined therein for receiving substrates and a first solution. The revolving unit is received in the receiving space and rotatable relative to the first vessel to impart a centrifugal force to the first solution. The drive shaft is coupled to the revolving unit. The motor is configured for rotating the revolving unit.

20 Claims, 5 Drawing Sheets

COATING APPARATUS

BACKGROUND

1. Technical Field

The disclosure relates to coating technology and, particularly, to a coating apparatus for coating uniform films on a number of substrates.

2. Description of Related Art

Spin coating is a typical procedure used to apply a film to a substrate. In one typical operation, a solution containing material to be coated on the substrate and a solvent is applied on the substrate, and the substrate is rotated at high speed to spread the solution on the substrate by centrifugal force. As the solvent is volatilized or evaporated, the material is coated on the substrate, thus forming the film on the substrate.

Spin coating is widely used in micro fabrication. It is, however, difficult to achieve a number of films on a number of respective substrates at a time by applying spin coating. At present, the efficiency of applying films on the substrates by applying spin coating is quite limited.

Therefore, what is needed, is a coating apparatus, which can overcome the above shortcomings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Embodiment of the coating apparatus will now be described in detail below and with reference to the drawings.

Figure 1:
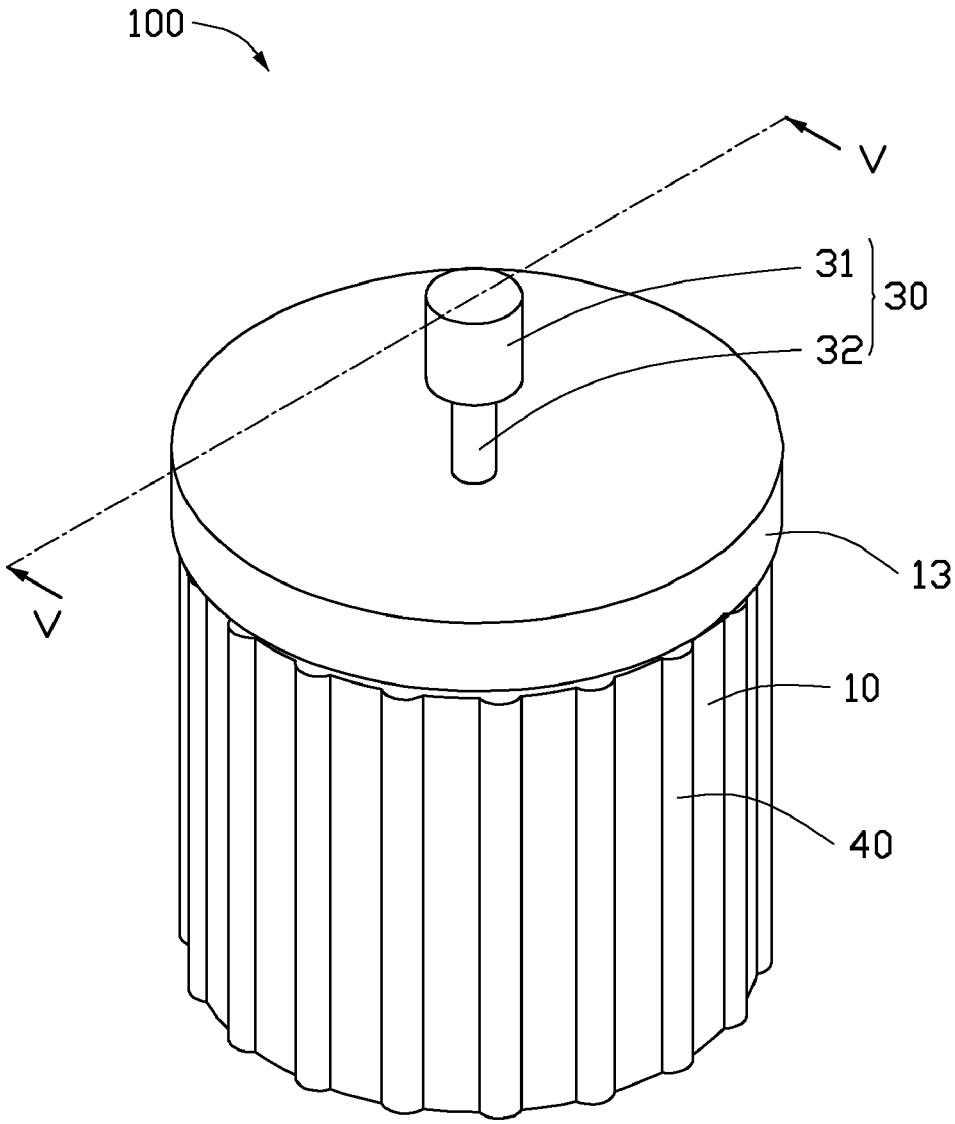
FIG. 1 is an isometric view of a coating apparatus in accordance with an exemplary embodiment.
Figure 2:
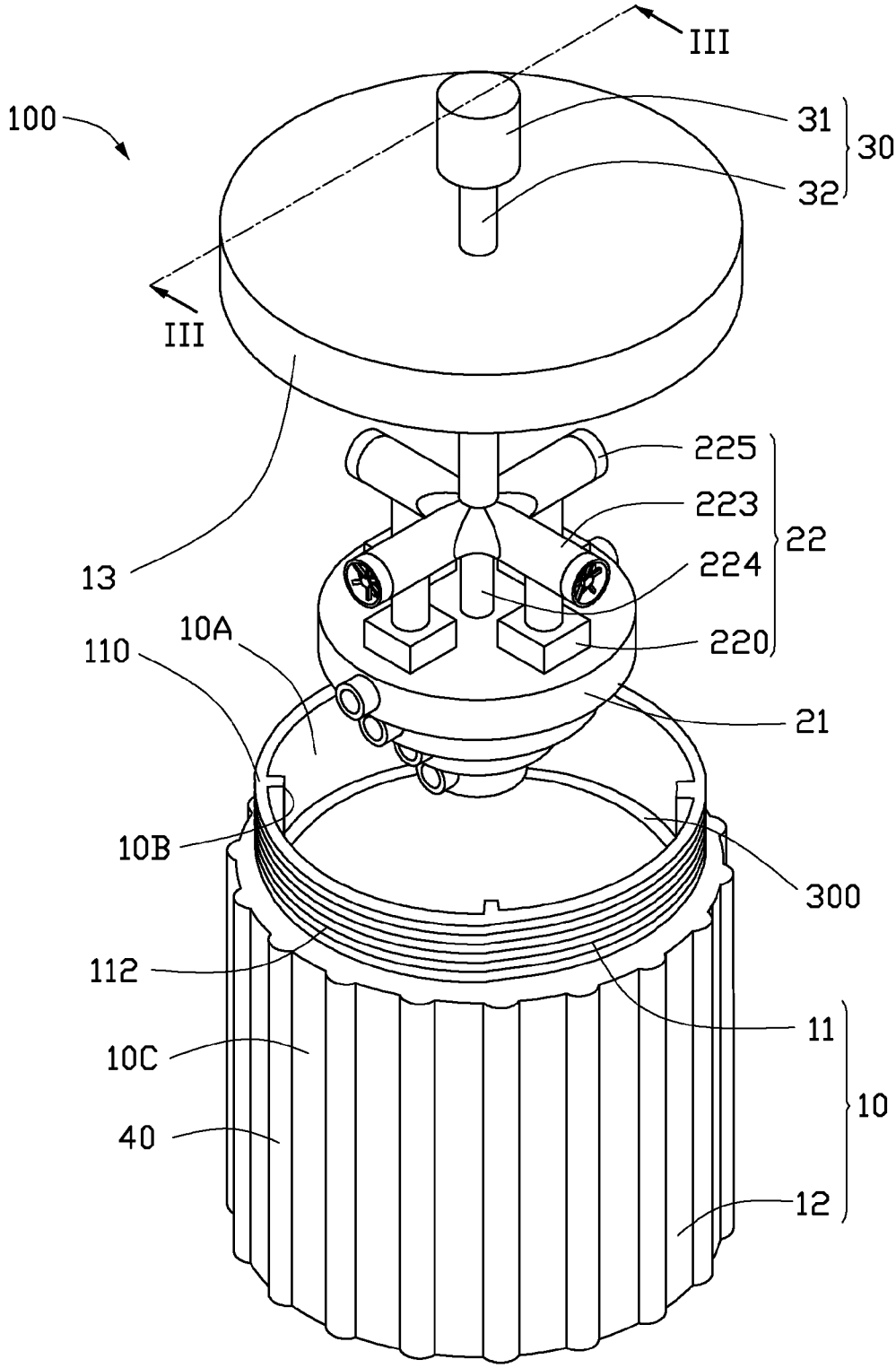
FIG. 2 is a disassembled isometric view of the coating apparatus of FIG. 1.
Figure 3:
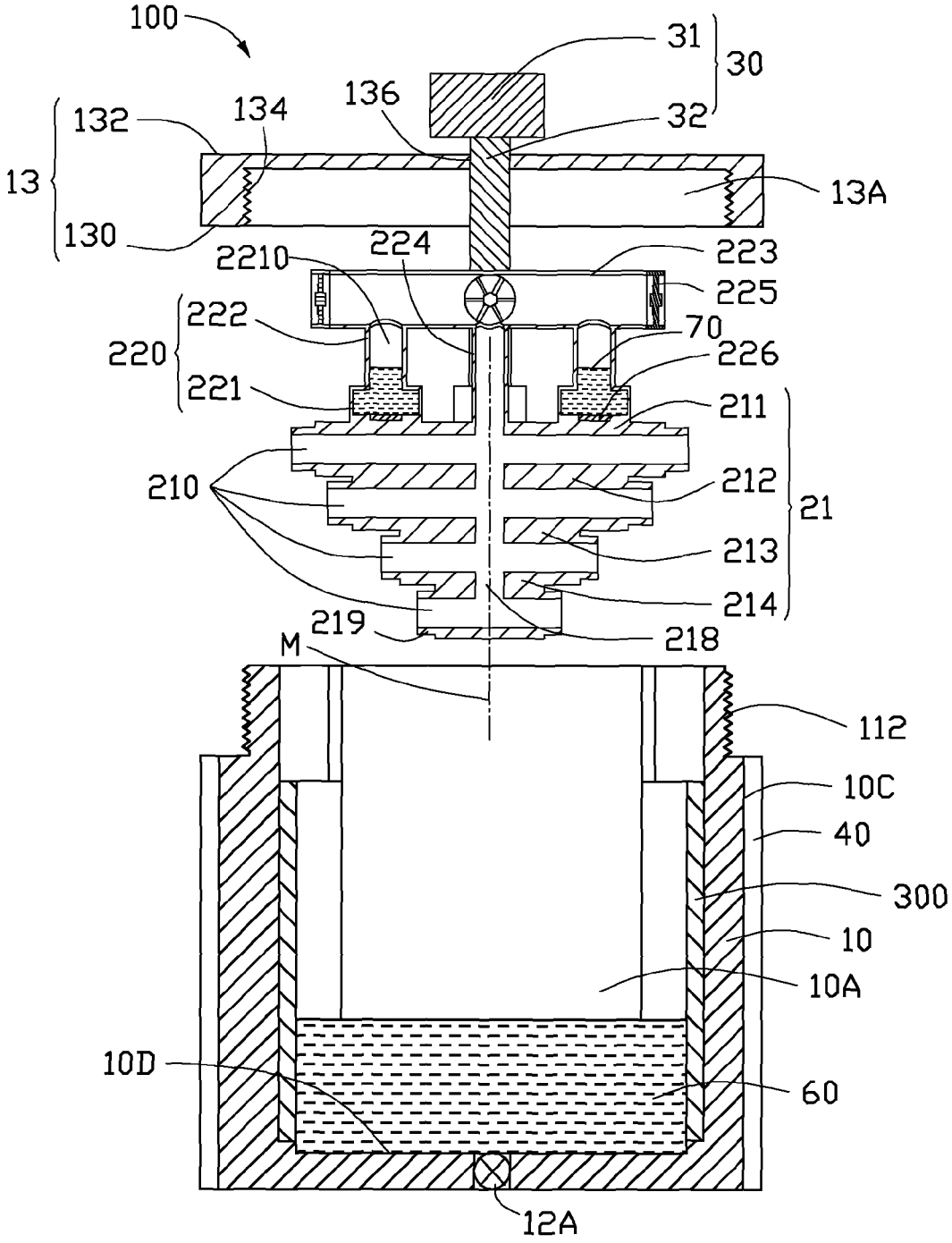
FIG. 3 is cross section of the coating apparatus of FIG. 2, taken from line III-III.

Referring to FIG. 1 to FIG. 3, an apparatus 100 in accordance with an exemplary embodiment is shown. The apparatus 100 includes a first vessel 10, a cover 13, a revolving unit 21, an atomizing unit 22, a drive mechanism 30, and a number of heating elements 40.

Referring to FIGS. 2 and 3, the first vessel 10 is generally in the form of a cylinder having a receiving space 10A defined therein. The receiving space 10A is configured for receiving a first solution 60. The first vessel 10 has an interior peripheral surface 10B in the receiving space 10A, and an exterior side surface 10C outside the receiving space 10A, and a bottom surface 10D (see FIG. 3). The bottom surface 10D is located at the bottom of the first vessel 10, and adjoins the interior peripheral surface 10B. In this embodiment, the first vessel 10 includes a first end 11 and a second end 12 at opposite sides thereof. The first end 11 has an end surface 110 adjoining the interior peripheral surface 10B and the exterior side surface 10C. In addition, the first end 11 is open, and the receiving space 10A is defined in the end surface 110 and exposed to an exterior of the first vessel 10 thereat. Moreover, the first end 11 has external threads 112 defined in the exterior side surface 10C thereof. The second end 12 is generally closed with a valve 12A defined in a central portion of the bottom surface 10D (see FIG. 3).

Figure 4:
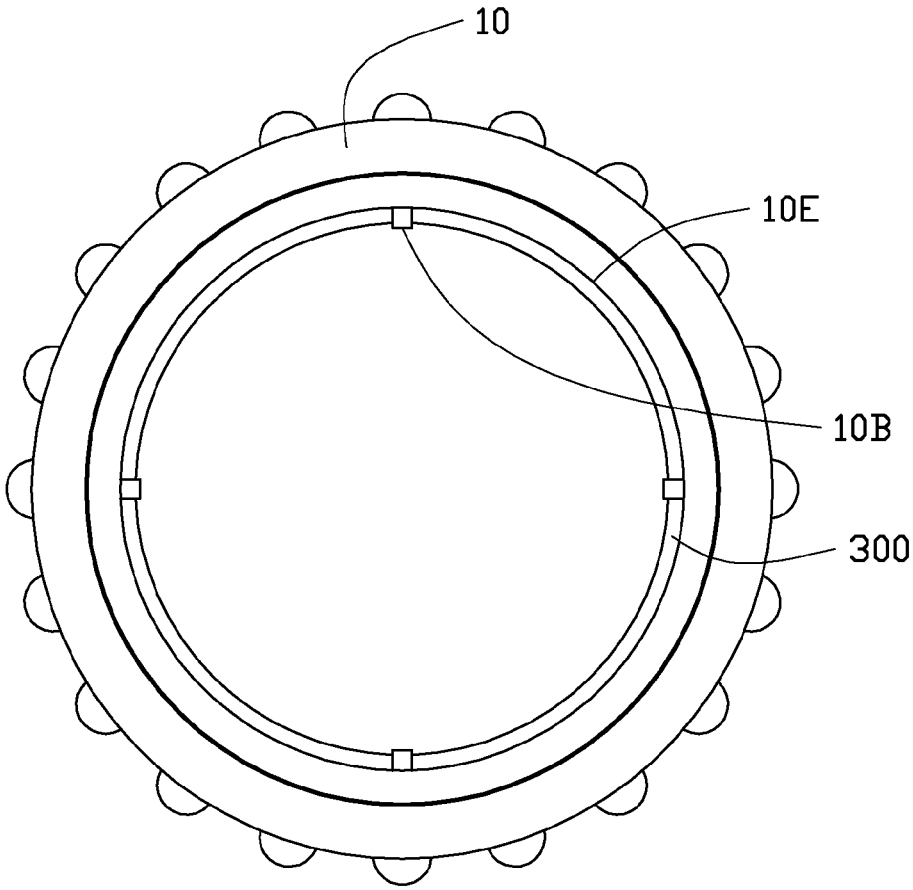
FIG. 4 is a top plan view of a first vessel of the coating apparatus of FIG. 2, the first vessel having a number of substrates arranged therein.

Referring also to FIG. 4, the first vessel 10 has four receiving recesses 10E defined in the interior peripheral surface 10B thereof. Each of the receiving recesses 10E extends from the first end 11 to the second end 12. The four receiving recesses 10E are configured for receiving four respective substrates 300. In this embodiment, the substrates 300 each are generally arc-shaped, and are spaced from one another around an axis of the first vessel 10. In alternative embodiments, the substrate 300 may have another shape, such as cuboid shape. In other alternative embodiments, the number of the receiving recesses 10E is not limited to the above illustrated embodiment. The first vessel 10 having only one, two, three or more than four recesses 10E defined therein should also be considered to be within the scope of the disclosure.

The cover 13 includes a first surface 130 and a second surface 132 at opposite sides thereof (see FIG. 3). The first surface 130 faces the first vessel 10. The second surface 132 faces away from the first vessel 10. In this embodiment, the cover 13 has a hole 13A defined in the first surface 130, and includes an interior peripheral surface (not labeled) in the hole 13A. The cover 13 has internal threads 134 defined in the interior peripheral surface thereof. In addition, the cover 13 has a through hole 136 defined in a central portion of the second surface 132. The through hole 136 communicates with the hole 13A. The cover 13 is used to enclose the first end 11 of the first vessel 10 by engagement of the internal threads 134 of the cover 13 with the external threads 112 of the first end 11.

The revolving unit 21 is generally cylindrically shaped, or has another suitable shape. In this embodiment, the revolving unit 21 has a central axis M, and includes four concentric steps, for example, a first step 211, a second step 212, a third step 213, and a fourth step 214 (see FIG. 3). Each of the first, the second, the third, and the fourth steps 211, 222, 223, 224 is generally cylindrically shaped or disk shaped. The first, the second, the third, and the fourth steps 211, 222, 223, 224 are coaxially aligned with one another, and overlap with one another in sequence in a direction parallel to the central axis M. The first step 211 is the one nearest to the cover 13, and the fourth step 214 is the one farthest to the cover 13. In this embodiment, the revolving unit 21 tapers toward the bottom surface 10D in the first vessel 10. That is, diameters of the first, the second, the third, and the fourth steps 211, 222, 223, 224 decrease as distance between the first, the second, the third, the fourth steps 211, 222, 223, 224 and the bottom surface 10D decreases. The diameter of the first step 211 is generally equal to or smaller than a diameter of the receiving space 10A. The first, the second, the third, and the fourth steps 211, 222, 223, 224 each have a first hole 210 defined in a radial direction thereof. In this embodiment, the revolving unit 21 includes four first holes 210 defined therein. The four first holes 210 each are cylindrical, and are parallel to each another. In addition, the revolving unit 21 has a second hole 218 defined in an axial direction thereof. The second hole 218 is also cylindrical, and communicates with the first, the second, the third, and the fourth steps 211, 222, 223, 224. In this embodiment, each of the first, the second, the third, and the fourth steps 211, 222, 223, 224 has two protrusions 219 protruding from two opposite sides along the radial direction thereof. Each of the first holes 210 extends through the two protrusions 219. In this embodiment, the protrusion 219 is cylindrical. The first, the second, the third, and the fourth steps 211, 222, 223, 224, as well as the protrusions 219 are integrally formed. In alternative embodiments, the revolving unit 21 including may only two, three or more than four steps should also be considered to be within the scope of the disclosure.

The atomizing unit 22 includes four second vessel 220, two first pipes 223, a second pipe 224, four air blowing members 225, and four atomizing elements 226 (see FIG. 2 and FIG. 3). Each second vessel 220 includes a base 221 and a protruding portion 222. The four bases 221 are located on the first step 211 of the revolving unit 21 and arranged around the central axis M of the revolving unit 21. Each of the four bases 221 may be cuboid shaped. The four protruding portions 222 protrude from the four respective bases 221, and each may be cylindrically shaped. In this embodiment, each second vessel 220 has a chamber 2210 defined therein for receiving a second solution 70 therein.

The two first pipes 223 intersect and communicate with each other. In this embodiment, the two first pipes 223 are perpendicular with each other and located at a common plane perpendicular to the drive shaft 32 of the motor 31. In addition, the two first pipes 223 each include two opposite ends facing away from an intersection of the two first pipes 223. The two opposite ends of each second pipe 224 are open, and are exposed to an exterior of the second pipe 224. In this embodiment, the two ends of each second pipe 224 serve as inlets, and are configured for allowing air from an ambient environment flowing therethrough to the inside thereof.

The second pipe 224 is located between and connected to the intersection of the two first pipes 223 and the first step 211 of the revolving unit 21. In this embodiment, the second pipe 224 communicates with the two first pipes 223 and the second hole 218 of the revolving unit 21.

The four atomizing elements 226 are arranged in the four respective chamber 2210. In this embodiment, each of the atomizing elements 226 is an ultrasonic atomizer. The ultrasonic atomizer includes an electronic oscillator (not shown) and an ultrasonic atomization transducer (not shown). The transducer vibrates ultrasonically to break up the second solution 70 into vapors by spray pyrolysis of the second solution 70. The frequency of ultrasonic vibration is controlled by the electronic oscillator. In this embodiment, the electronic oscillator may for example, be a crystal oscillator. The transducer operates in frequencies from 1.5 MHz to 2.4 MHz.

The four air blowing members 225 are arranged in the two first pipes 223 at four respective ends thereof. In this embodiment, the air blowing member 225 can be a fan (not labeled). While operating the fans, the air is drawn into the first pipes 223. The vapors flow from first pipes 223 to the second pipe 224. The flowing of the vapors is promoted by the flowing of the air drawn by the fans. In this embodiment, the vapors flow to each of the first holes 210 through the second hole 218, and are subsequently discharged to the outside of the revolving unit 21 through the first holes 210.

The drive mechanism 30 includes a motor 31 with a drive shaft 32. In this embodiment, the drive shaft 32 extends through the hole 136 of cover 13 and aligns with the central axis M of the revolving unit 21. The drive shaft 32 includes an end facing away from the motor 31 and connected to the intersection of the two first pipes 223. The drive mechanism 30 may further includes another drive unit (not shown) for moving the motor 31 and the drive shaft 32 toward or away from the second end 12 of the first vessel 10 along a direction parallel to the central axis M of the revolving unit 21.

The heating elements 40 each can be a heating rod. In this embodiment, the heating elements 40 are arranged around the first vessel 10, and are attached on the exterior side surface 10C of the first vessel 10. In alternative embodiments, the heating elements 40 may be attached on the interior peripheral surface 10B of the first vessel 10.

Figure 5:
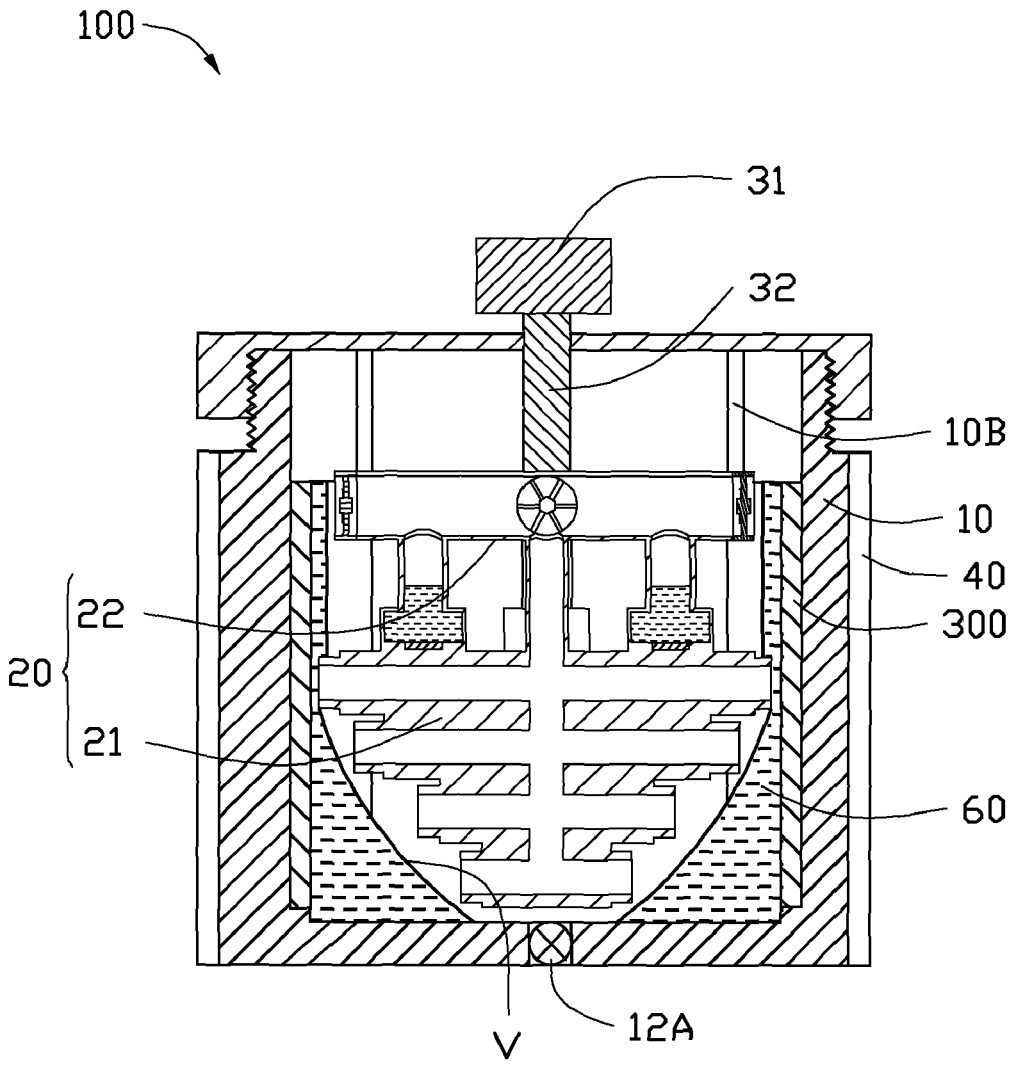
FIG. 5 is cross section of the coating apparatus of FIG. 1 taken from line V-V, showing a revolving unit being rotated to create a vortex in a first vessel.

Referring also to FIG. 5, in operation, the apparatus 100 may be used to apply hydrothermal synthesis and spray pyrolysis, thus forming four films (not shown) on the four respective substrates 300. In one aspect, when the apparatus 100 is used to apply hydrothermal synthesis, the first vessel 10 serves as an autoclave, and a first film is coated on each substrate 300 by applying a first solution 60 thereto. In another aspect, when the apparatus 100 is used to apply spray pyrolysis, the atomizing elements 226 is used to break up the second solution 70 into vapors, and a second film is coated on the first film of each substrate 300 by applying the vapors thereto. The first solution 60 and the second solution 70 each contain material to be coated on the substrates 300 and a solvent. In this embodiment, the material in the first solution 60 can be different from or the same as material in the second solution 70. For example, the solvent may be methanol, and the material can be $Zn(acc)_2$ dissolved in the solvent.

In operation, the first solution 60 is fed into the receiving space 10A of the first vessel 10 through the valve 12A. When a certain amount of first solution 60 is fed into the first vessel 10, the valve 12A is closed. Subsequently, the motor 31 is turned on, the drive shaft 32 rotates the atomizing unit 22 and the revolving unit 21. In this embodiment, another drive unit can be provided and configured to move the revolving unit 21 in the receiving space 10A toward the second end 12 of the first vessel 10. The rotational motion of the revolving unit 21 is transmitted to the first solution 60 in the first vessel 10 to impart a centrifugal force to the first solution 60, thus a vortex V is created in a surface of the first solution 60. The centrifugal force presses the first solution 60 in the first vessel 10 to flow along the interior peripheral surface 10B, thus fully covering surfaces of the substrates 300. By maintaining a temperature gradient in the first vessel 10, the first solution 60 becomes supersaturated and crystallization sets in. Thus, the material in the form of crystal coated on the substrates 300. In this manner, the first films are coated on the respective substrate 300.

When the first films are coated on the substrates 300, the valve 12A can be open again. The heating elements 40 are turned on, thus heating a base material of the first vessel 10. The heat is then transmitted to the first solution 60 via the substrates 300, and excess first solution 60 is drained out of the first vessel 10 through the valve 12A.

In this embodiment, the second films can be further coated on the first films of the substrates 300 by applying the spray pyrolysis. In one typical example, when the first films are coated on the substrates 300, the atomizing unit 22 then operates. The second solution 70 in the chambers 2210 are broken up into vapors, and the vapors are discharged to the substrates 300 through the first holes 210 of the revolving unit 21. As such, the second films are coated on the first films of the substrates 300.

One advantage of the coating apparatus 100 is that the coating apparatus 100 is equipped with the revolving unit 21 and the drive mechanism 30. The revolving unit 21 is rotated by the drive mechanism 30 to impart a centrifugal force to the first solution 60, thus the first solution 60 can be forced by the centrifugal force to fully contact surfaces of the substrates 300, and the first solution 60 can be uniformly dispersed and the first films can be uniformly coated on the substrates 300. Another advantage of the coating apparatus 100 is that the apparatus 100 can be used to apply hydrothermal synthesis, as well as spray pyrolysis on a number of substrates 300. Thus, the second films can be further formed on the first films by applying the spray pyrolysis, as the first films is formed on the substrates 300 by applying hydrothermal synthesis. In this way, multi-films can be formed on the substrates 300 efficiently.

It is understood that the above-described embodiment are intended to illustrate rather than limit the disclosure. Variations may be made to the embodiment without departing from the spirit of the disclosure. Accordingly, it is appropriate that the appended claims be construed broadly and in a manner consistent with the scope of the disclosure.

What is claimed is:

1. A coating apparatus comprising:

a first vessel having a receiving space defined therein for receiving a plurality of substrates and a first solution;

a revolving unit received in the receiving space and rotatable relative to the first vessel to impart a centrifugal force to the first solution, the revolving unit comprising a plurality of concentric steps and being tapered toward a bottom in the first vessel;

a motor having a drive shaft, the drive shaft being coupled to the revolving unit, the motor being configured for rotating the revolving unit, and a central axis of the revolving unit aligning with the drive shaft; and an atomizing unit, the atomizing unit comprising:

a second vessel for receiving a second solution;

an atomizing element received in the second vessel for atomizing the second solution; and at least one pipe, wherein the revolving unit has at least one through hole defined therein, the at least one pipe connecting the second vessel to the revolving unit, and the at least one pipe is configured for guiding the atomized second solution from the second vessel to the first vessel via the at least one through hole.

2. The coating apparatus of claim 1, wherein the at least one through hole comprises a plurality of first holes and a second hole communicating with the first holes, the first holes opening toward an inner sidewall of the first vessel, the second hole extending along the central axis of the revolving unit.

3. The coating apparatus of claim 1, wherein the atomizing element comprises at least one ultrasonic atomizer, the at least one pipe comprises two first pipes and a second pipe, the two first pipes intersecting and communicating with each other, and the two first pipes are located on a common plane substantially perpendicular to the drive shaft, the drive shaft is connected to an intersection of the first pipes, and the second pipe is connected between the intersection of the first pipes and the revolving unit, with the second pipe communicating with the second hole of the revolving unit.

4. The coating apparatus of claim 3, wherein the atomizing element further comprises four air blowing members configured for promoting flowing of the atomized second solution from the first pipes to the first holes of the revolving unit.

5. A coating apparatus comprising:

a first vessel having a receiving space defined therein for receiving a plurality of substrates and a first solution;

a revolving unit received in the receiving space and rotatable relative to the first vessel to impart a centrifugal force to the first solution; and an atomizing unit comprising:

a second vessel for receiving a second solution;

an atomizing element received in the second vessel for atomizing the second solution; and at least one pipe, wherein the revolving unit has at least one through hole defined therein, the at least one pipe connecting the second vessel to the revolving unit, and the at least one pipe is configured for guiding the atomized second solution from the second vessel to the first vessel via the at least one through hole; and a motor having a drive shaft, the drive shaft being coupled to the revolving unit, the motor being configured for rotating the revolving unit.

6. The coating apparatus of claim 5, wherein the first vessel comprises an open end and a closed end at an opposite side thereof to the open end.

7. The coating apparatus of claim 6, further comprising a cover attached to the open end, wherein the cover has a through hole defined therein, the drive shaft extending through the through hole.

8. The coating apparatus of claim 7, wherein the revolving unit has a central axis aligning with the drive shaft, and the revolving unit tapers toward a bottom in the first vessel and comprises a plurality of concentric steps.

9. The coating apparatus of claim 5, wherein the at least one through hole comprises a plurality of first holes and a second hole communicating with the first holes, the first holes opening toward an inner sidewall of the first vessel, the second hole extending along the central axis of the revolving unit.

10. The coating apparatus of claim 5, wherein the atomizing element comprises at least one ultrasonic atomizer.

11. The coating apparatus of claim 5, wherein the at least one pipe comprises two first pipes and a second pipe, the two first pipes intersecting and communicating with each other, and the two first pipes are located on a common plane substantially perpendicular to the drive shaft, the drive shaft being connected to an intersection of the first pipes, the second pipe is connected between the intersection of the first pipes and the revolving unit, the second pipe communicating with the second hole of the revolving unit.

12. The coating apparatus of claim 11, wherein the atomizing element comprises four air blowing members configured for promoting flowing of the atomized second solution from the first pipes to the first holes of the revolving unit.

13. A coating apparatus comprising:

a first vessel having a receiving space defined therein for receiving a first solution and an interior peripheral surface surrounding the receiving space, and at least two receiving recesses being defined by the interior peripheral surface thereof for receiving at least one substrate;

a revolving unit received in the receiving space and rotatable relative to the first vessel to impart a centrifugal force to the first solution, such that the centrifugal force presses the first solution in the first vessel to flow along the interior peripheral surface and fully cover surfaces of the at least one substrate; and a motor having a drive shaft, the drive shaft being coupled to the revolving unit, the motor being configured for rotating the revolving unit.

14. The coating apparatus of claim 13, wherein the revolving unit has a central axis aligning with the drive shaft, and the revolving unit tapers toward a bottom in the first vessel and comprises a plurality of concentric steps.

15. The coating apparatus of claim 14, further comprising an atomizing unit, the atomizing unit comprising:

a second vessel for receiving a second solution;

an atomizing element received in the second vessel for atomizing the second solution; and at least one pipe, wherein the revolving unit has at least one through hole defined therein, the at least one pipe connecting the second vessel to the revolving unit, and the at least one pipe is configured for guiding the atomized second solution from the second vessel to the first vessel via the at least one through hole.

16. The coating apparatus of claim 15, wherein the at least one through hole comprises a plurality of first holes and a second hole communicating with the first holes, the first holes opening toward an inner sidewall of the first vessel, the second hole extending along the central axis of the revolving unit.

17. The coating apparatus of claim 15, wherein the atomizing element comprises at least one ultrasonic atomizer vibrating ultrasonically to break up the second solution into vapors.

18. The coating apparatus of claim 17, wherein the at least one pipe comprises two first pipes and a second pipe, the two first pipes intersecting and communicating with each other, and the two first pipes are located on a common plane substantially perpendicular to the drive shaft, the drive shaft being connected to an intersection of the first pipes, the second pipe is connected between the intersection of the first pipes and the revolving unit, the second pipe communicating with the second hole of the revolving unit.

19. The coating apparatus of claim 18, wherein the atomizing element further comprises four air blowing members configured for promoting flowing of the atomized second solution from the first pipes to the first holes of the revolving unit.

20. The coating apparatus of claim 13, further comprising a plurality of heating elements arranged around the first vessel.

* * * * *